US010151189B2

(12) United States Patent
Busengdal et al.

(10) Patent No.: US 10,151,189 B2
(45) Date of Patent: Dec. 11, 2018

(54) SINGLE TRIP—THROUGH DRILL PIPE PROPPANT FRACTURING METHOD FOR MULTIPLE CEMENTED-IN FRAC SLEEVES

(71) Applicant: Dreco Energy Services ULC, Edmonton (CA)

(72) Inventors: Paul David Busengdal, Stavanger (NO); Tore Sørheim, Randaberg (NO); Tom Rune Koløy, Sandnes (NO); Ståle Granberg, Sandnes (NO); Pål Zon Rafdal, Hommersåk (NO); Nicolai Isaak Stubbrud, Stavanger (NO); Jarle Trones, Sandnes (NO)

(73) Assignee: DRECO ENERGY SERVICES ULC, Calgary (CA)

( * ) Notice: Subject to any disclaimer, the term of this patent is extended or adjusted under 35 U.S.C. 154(b) by 225 days.

(21) Appl. No.: 14/961,097

(22) Filed: Dec. 7, 2015

(65) Prior Publication Data

US 2016/0160608 A1 Jun. 9, 2016

Related U.S. Application Data

(60) Provisional application No. 62/088,101, filed on Dec. 5, 2014.

(51) Int. Cl.

| | |
|---|---|
| ***E21B 43/14*** | (2006.01) |
| ***E21B 34/14*** | (2006.01) |
| ***E21B 43/267*** | (2006.01) |
| *E21B 34/00* | (2006.01) |

(52) U.S. Cl.
CPC ..... *E21B 43/267* (2013.01); *E21B 43/14* (2013.01); *E21B 2034/007* (2013.01)

(58) Field of Classification Search
CPC ..... E21B 43/26; E21B 34/14; E21B 43/14; E21B 2034/007
See application file for complete search history.

(56) References Cited

U.S. PATENT DOCUMENTS

| | | | | |
|---|---|---|---|---|
| 4,401,158 | A * | 8/1983 | Spencer | E21B 33/124 166/113 |
| 4,858,690 | A * | 8/1989 | Rebardi | E21B 34/12 166/113 |
| 6,216,785 | B1 * | 4/2001 | Achee, Jr. | E21B 33/124 166/278 |
| 6,464,006 | B2 * | 10/2002 | Womble | E21B 43/045 166/205 |
| 6,957,701 | B2 | 10/2005 | Tolman et al. | |
| 9,140,097 | B2 * | 9/2015 | Themig | E21B 34/063 |
| 9,745,826 | B2 * | 8/2017 | Getzlaf | E21B 23/02 |
| 2009/0095471 | A1 * | 4/2009 | Guignard | E21B 34/14 166/278 |
| 2010/0126725 | A1 | 5/2010 | Ravensbergen | |
| 2012/0048559 | A1 | 3/2012 | Ganguly et al. | |
| 2012/0080190 | A1 | 4/2012 | Rytlewski | |

(Continued)

OTHER PUBLICATIONS

Search Report dated Oct. 20, 2016 in corresponding Danish Application No. PA 2015 00786.

*Primary Examiner* — Kipp C Wallace
(74) *Attorney, Agent, or Firm* — Conley Rose, P.C.

(57) ABSTRACT

The present invention relates to a method, a system (1) and tool(s) (300, 2, 3) for single trip through drill pipe proppant fracturing of subterranean formations (130) surrounding oil and/or gas production wells (100).

18 Claims, 15 Drawing Sheets

(56) References Cited

U.S. PATENT DOCUMENTS

| | | | | |
|---|---|---|---|---|
| 2012/0325484 | A1* | 12/2012 | Patel | E21B 34/14 166/308.2 |
| 2013/0014953 | A1 | 1/2013 | van Petegem | |
| 2015/0083440 | A1* | 3/2015 | Andersen | E21B 34/14 166/387 |

* cited by examiner

BHA tool 300 functions:

Run in hole

Activated locator device and frac shifting tools.

Activated Port Sub.

Deactivated "No Go" tool and frac shifting tools.

Activated production opening shifting tool.

SINGLE TRIP—THROUGH DRILL PIPE PROPPANT FRACTURING METHOD FOR MULTIPLE CEMENTED-IN FRAC SLEEVES

FIELD OF THE INVENTION

This invention relates to tool(s), a system and a method for fracturing subterranean formations surrounding oil and/or gas wells.

BACKGROUND OF THE INVENTION

The present methodology for extended reach fracturing is very time demanding. This makes thus many potential projects and/or wells uneconomical. The existing systems utilize staged perforations, installation of a dedicated straddle system and targeted stimulation of each individual stage in the process. The process is repeated for the number of stages in the well. Each stage then requires multiple installation trips in order to complete the stage, thus causing a single stage to require several days of installation time. This well construction method reduces the effective well diameter for production flow.

One known method is the P.S.I. (Perforate-Stimulate-Isolate) system provided to an operator by an incumbent service provider. Similar methods have been used in coiled tubing applications where the frac is pumped down the annulus. The challenge here is how to use multiple cemented-in frac sleeves on a liner and to perform the frac through a drill pipe into each frac sleeve individually. The drill pipe string is to remain in the well throughout the entire fracturing process. The drill pipe can be a requirement as the frac stages are out of range for coiled tubing operations.

Therefore, an improved way of proppant fracturing of wells is needed. Thus there is a request and/or need for a system which can provide great time savings from the known P.S.I. (Perforate-Stimulate-Isolate) system that has been used in the past 20 years.

SUMMARY OF THE INVENTION

The present invention offers an efficient, cost saving proppant fracturing through cemented reservoir sliding sleeves without over-displacing the frac. The frac operation is performed through a threaded pipe in order to enable fracturing in extended reach wells. Well control should be ensured during the deployment and the frac operation. In order to enable proppant retention a sand filtration media can be used as part of the sleeve(s).

Modified frac sleeves can be utilized in order to be run as part of the liner and cemented in place. The modification of each reservoir sliding sleeve includes the inclusion of a dedicated sleeve production position, where the production is filtered in order to retain the proppants in the frac.

Use of dedicated no-go liner ID (inner diameter) restriction(s) in each stage can contribute to efficiently slack off the drill pipe string weight in order to ensure operational robustness during the frac. This can also enable operationally robust frac treatment method(s) and/or option(s) for wells drilled from floating platforms in rough seas.

Inner BHA (bottom hole assembly) can use flexible no-go locator sub, adaptable sleeve shifting tools and a compression activated ported frac sub.

The components that make up the entire system have small or major modifications with respect to existing parts.

The main features of the present invention are given in the attached independent claims. Additional features of the invention are presented in the attached dependent claims.

BRIEF DESCRIPTION OF THE DRAWINGS

These and other aspects of the invention are apparent from and will be further elucidated, by way of example(s), with reference to the attached drawings, wherein.

DESCRIPTION OF THE PREFERRED EMBODIMENTS

Figure 1:
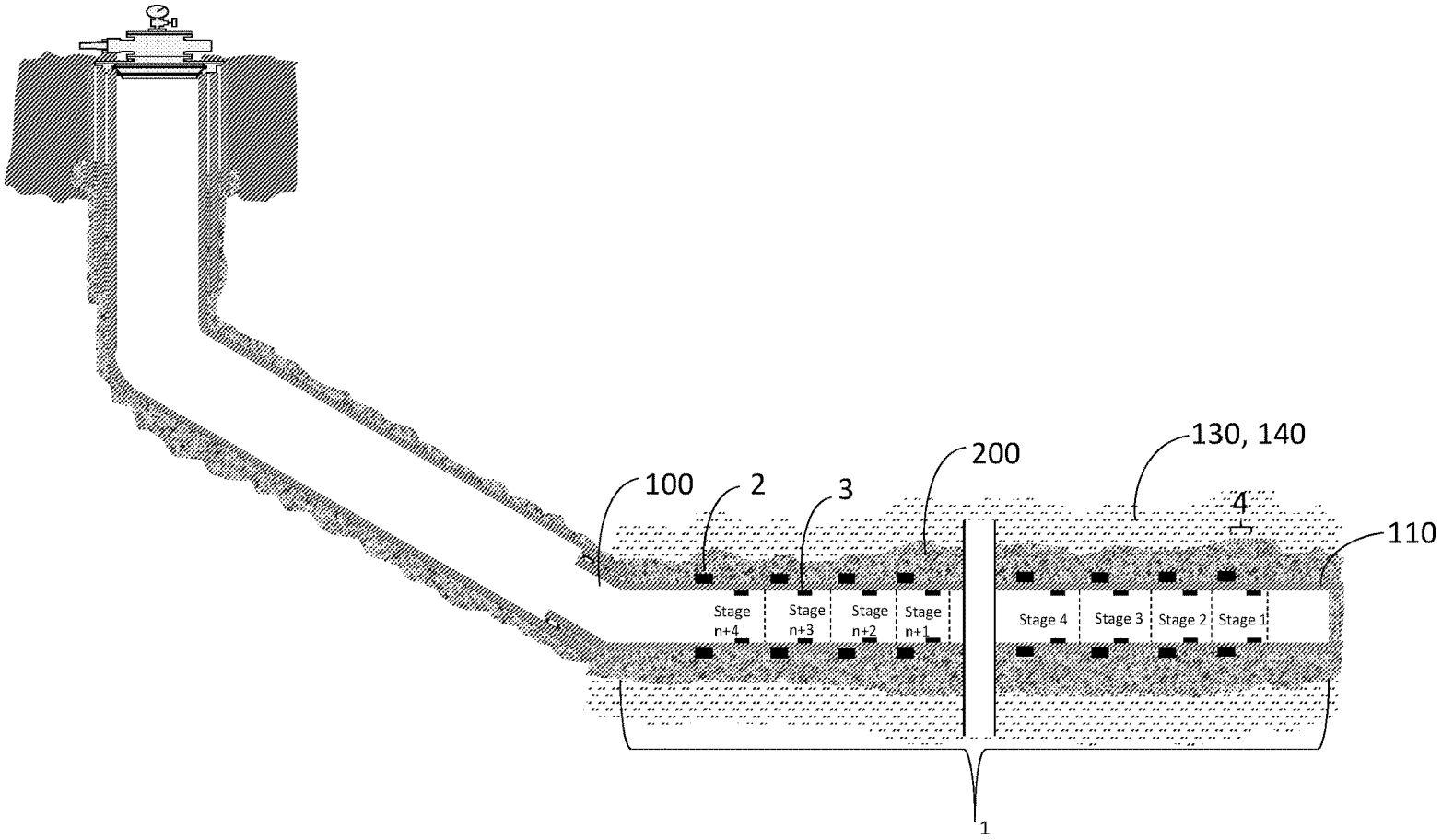
FIGS. 1, 2 and 4 show embodiments of the system according to the present invention.

The invention includes all permanently installed reservoir completion equipment run as part of the initial reservoir liner 110.

The use of a jointed service string enables the frac operation also in extended reach applications out of coiled tubing reach.

The frac is pumped through a temporarily installed service string which is sequentially located at each sleeve/injection point. The service string 120 includes devices 300, 7, 8, 9 to manipulate the frac sleeves 2 from closed run-in position, to opened frac position, back to closed position and to open for production position.

The frac sleeve 2 includes a feature which will retain the proppants in the frac eliminating the potential for proppant flow back and frac closure.

A packer (not shown) might still be incorporated a distance above the frac string BHA for well control purposes.

Proppant frac can be run through the inside of a jointed service string.

Figure 2:
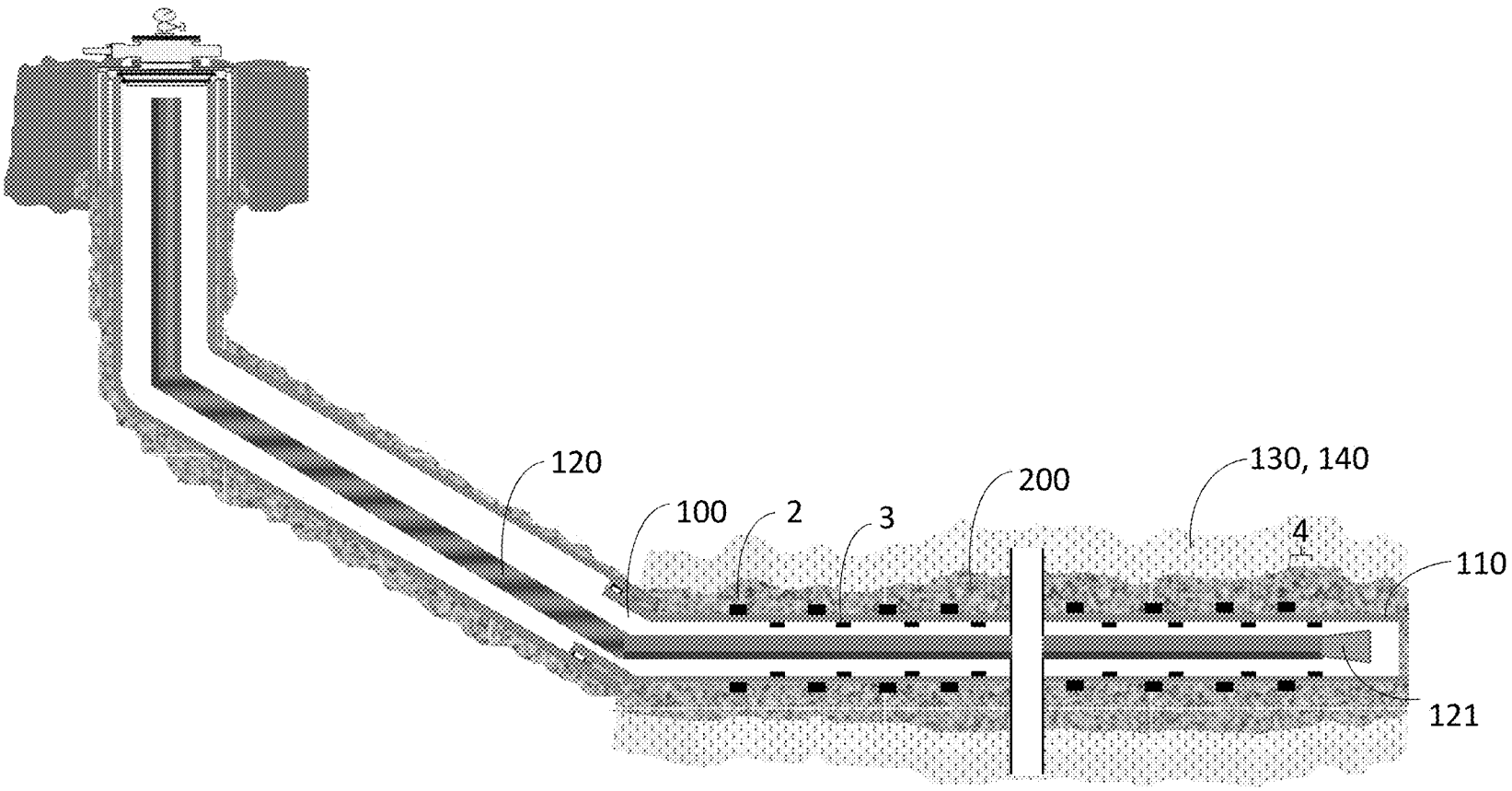
Figure 4:
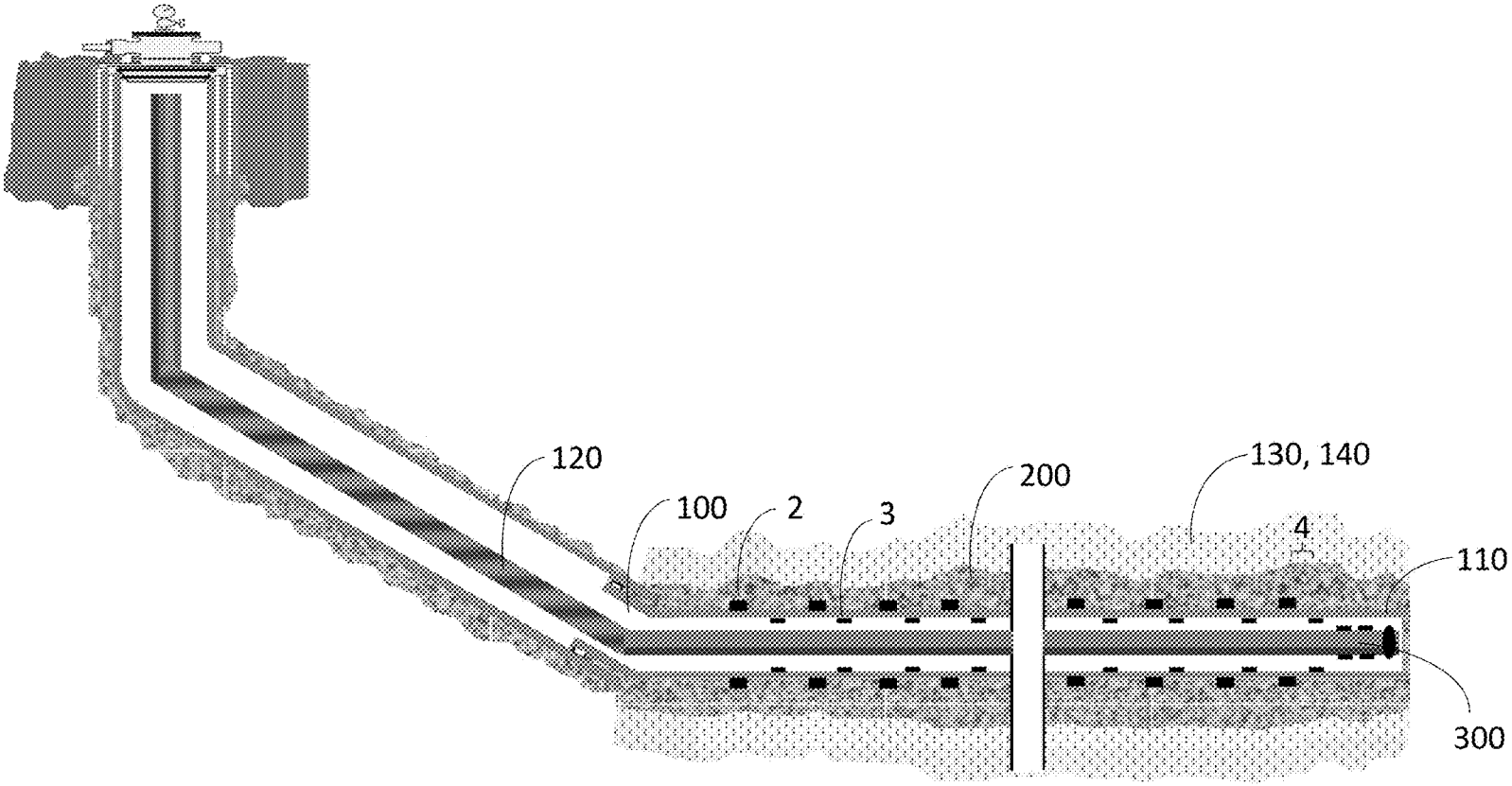

The system 1, according to the invention and shown in FIGS. 1, 2 and 4, utilizes a predetermined number of frac sleeves 2 which are run as part of a liner 110 in a wellbore 100 in a subterranean formation 130, wherein an oil and/or gas reservoir 140 is to be utilized, and being cemented 200 in place. Each reservoir sliding sleeve 2 includes a dedicated production position, where the production is being filtered in order to retain the proppants in the frac.

Use of dedicated no-go liner ID restriction(s) 3 in each stage contributes to efficiently slack off the drill pipe string 120 weight in order to ensure operational robustness during the frac operation. This can also enable operationally robust frac treatment method(s) and/or option(s) for wells 100 drilled for example from floating platforms (not shown) in rough seas.

Inner BHA tool 300 uses a flexible no-go locator sub or device 6, adaptable sleeve shifting tools 7, 8, 9 and a compression activated frac sub 10 with a predetermined number of ports 12.

One embodiment of the invention concerns a BHA tool 300 for single trip through drill pipe proppant fracturing. The BHA tool 300 is at one end adapted to be attached to a string 120. The BHA tool 300 can comprise: i) a ported sub 10, ii) sleeve shifting tools 7, 8, 9, and iii) a locator sub 6. The locator sub 6 can be arranged at the other end of the BHA tool 300. The ported sub 10 can comprise a number of ports 12. The several ports 12 can have opened and closed positions. The sleeve shifting tools 7, 8, 9 can comprise: i)

a sleeve closing tool 7; ii) a sleeve fracturing opening tool 8; and iii) a sleeve production opening tool 9. The sleeve closing tool 7 can be adapted to close a certain sleeve 2 cemented in the liner 110 when the BHA tool 300 is moving or going up. The sleeve fracturing opening tool 8 can be adapted to open the sleeve 2 when the BHA tool 300 is moving or going down. The sleeve production opening tool 9 can be adapted to set the sleeve 2 in a production mode.

The ported sub 10 with its ports 12, the sleeve closing tool 7, the sleeve fracturing opening tool 8, the sleeve production opening tool 9 and the locator sub 6 can be arranged on the BHA tool 300 in such a manner that at least one of them would be able to cooperate with at least one of the following: the sleeve 2 in the liner 110, the ID restriction 3 in the liner 110 and the bottom of a wellbore 100.

Another embodiment of the invention teaches a system 1 for single trip through drill pipe proppant fracturing. The system 1 can comprise a predetermined number of sleeves 2 cemented in a liner 110 in a wellbore 100 in a subterranean formation 130 and a predetermined number of ID restrictions 3. In each stage throughout a certain or the entire length of the liner 110, there is a predetermined spacing or distance 4 between the ID restriction 3 and the sleeve 2. The system 1 can further comprise a BHA tool 300 as described above.

Yet another embodiment of the invention relates to a method for single trip through drill pipe proppant fracturing. The method can comprise the following steps:

a) arranging a liner 110 with a predetermined number of sleeves 2 and ID restrictions 3 in a wellbore 100 in a subterranean formation 130, wherein the sleeves 2 and the ID restrictions 3 are being cemented in the liner 110, and wherein, in each stage 1, 2, 3, 4 . . . n, n+1, n+2, n+3, n+4 throughout a certain or the entire length of the liner 110, the ID restriction 3 and the sleeve 2 are arranged with a predetermined spacing or distance 4 between them;

b) clean out run is performed by means of a string 120 having a clean out run string end 121, wherein the inside of the liner 110 is thus being flushed and cleaned;

c) lowering a BHA tool 300 being at one end adapted to be attached to the string 120 and comprising: i) a ported sub 10 with a number of ports 12 having opened and closed positions, ii) sleeve shifting tools 7, 8, 9, and iii) a locator sub 6 being arranged at the other end of the BHA tool 300. The sleeve shifting tools 7, 8, 9 can comprise: i) a sleeve closing tool 7 adapted to close the sleeve 2 when the BHA tool 300 is moving or going up; ii) a sleeve fracturing opening tool 8 adapted to open the sleeve 2 when the BHA tool 300 is moving or going down; and iii) a sleeve production opening tool 9 adapted to set the sleeve 2 in a production mode;

d) the string 120 with the BHA tool 300 is run to the bottom of the wellbore 100 passing through the top end of the liner 110 and all sleeve assemblies 2 and ID restrictions 3 without any interference;

e) the bottom of the wellbore 100 is tagged, and the locator sub 6, the sleeve fracturing opening tool 8 and the sleeve closing tool 7 are activated;

f) the BHA tool 300 is pulled up until the locator sub 6 indicates in lower most ID restriction 3;

g) the string 120 with the BHA tool 300 is pulled such that the sleeve shifting tools 7, 8, 9 are located above the sleeve 2 in the liner 110;

h) the string 120 with the BHA tool 300 is lowered, and the sleeve 2 is opened by the sleeve fracturing opening tool 8;

i) the BHA tool 300 is run in further, and the ID restriction 3 is tagged with the help of the locator sub 6;

j) the weight of the string 120 is slacked off the in order to confirm the frac position, wherein the slack off step opens the ports 12 of the ported sub 10 and the ported sub 10 is located parallel to the opened sleeve 2;

k) the annular 100 is closed, and injection is established, and then frac is pumped until screen out is established;

l) the annular 100 is opened, and a predetermined volume is reverse circulated in order to clean the area outside of the ported 12 sub 10;

m) the BHA tool 300 is pulled up, and the sleeve 2 is closed with the help of the sleeve closing tool 7;

n) the weight of the string 120 is slacked off, and the BHA tool 300 is relocated on the ID restriction 3 with the help of the locator sub 6;

o) all excess proppants from the string 120 are reverse circulated out;

p) the BHA tool 300 is pulled up, and the next ID restriction 3 is located;

q) then steps f)-p) are repeated for a desired number of stages or for all stages 1, 2, 3, 4 . . . n, n+1, n+2, n+3, n+4 throughout the liner 110.

When the desired number of or all stages 1, 2, 3, 4 . . . n, n+1, n+2, n+3, n+4 throughout the liner 110 are fractured and all sleeves 2 are closed, a drop ball 11 can be used in order to deactivate the locator sub 6, the sleeve fracturing opening tool 8 and the sleeve closing tool 7.

The activated sleeve fracturing opening tool 8 is adapted to be able to open all sleeves 2 when going down.

The activated sleeve closing tool 7 is adapted to be able to close any opened sleeve 2 when moving up.

The flexible no-go locator sub or device 6 can for example be built in a similar principle as a shifting tool. Here there can be some sort of "dogs" or "teeth" or "fins", but not limited only thereto, being able to expand by means of springs and the angle of the "dog" and the profile it should pass through, being designed and shaped, so that the locator sub or device 6 can collapse/can be pushed down when it is pulled in one direction. In the other direction, there are angle(s) making the "dogs" being hit in axial direction, and thus the locator sub or device 6/the "dogs" will not collapse. Alternatively, the locator sub or device 6 can be inflatable.

Here some of the functions of the sleeve 2 manipulating devices/adaptable shifting tools 7, 8, 9 will be explained. The sleeve closing tool 7 is a shift up tool (i.e. it works when moving up), while the fracturing opening tool 8 and the sleeve production opening tool 9 are shift down tools (i.e. they work when moving down). The fracturing opening tool 8 can open a sleeve 2 so that in order to stimulate. Frac can be pumped out of the sleeve 2 and into the formation 130. The sleeve closing tool 7 can close a sleeve 2 so that the volume can be circulated in the well 100. The sleeve production opening tool 9 can open a sleeve 2 for production.

The sleeve 2 can have three positions, where: position 1 (first position) is a closed position; in position 2 (second position) the proppant(s) can be pumped out from the well 100 into the formation 130; and position 3 (third position) is for production mode, where proppant is held back from the formation 130 and into the well 100. This third production position of the sleeve 3 can be screened/filtered. All this can explain why there can be there different shifting tools 7, 8, 9 arranged in the BHA 300.

Below system 1 and method overview and functionality of the preferred embodiment will be described.

1. The liner 110 with the number of frac sleeves 2 is run as required by reservoir conditions (see e.g. FIG. 1).

2. Each stage (see 1, 2, 3, 4 . . . n, n+1, n+2, n+3, n+4) consists of a frac sleeve 2 and a slight ID restriction 3 with the same and predetermined spacing or distance 4 between the ID restriction 3 and the sleeve 2.

3. The liner 110 is run as a conventional liner and cemented 200 per normal cementing procedures.

4. A dedicated clean out run is performed by means of a string 120 having a clean out run string end 121, wherein the inside of the liner 110 is thus being flushed and cleaned (see FIG. 2).

Figures 3A, 3B, 3C, 3D, 3E:
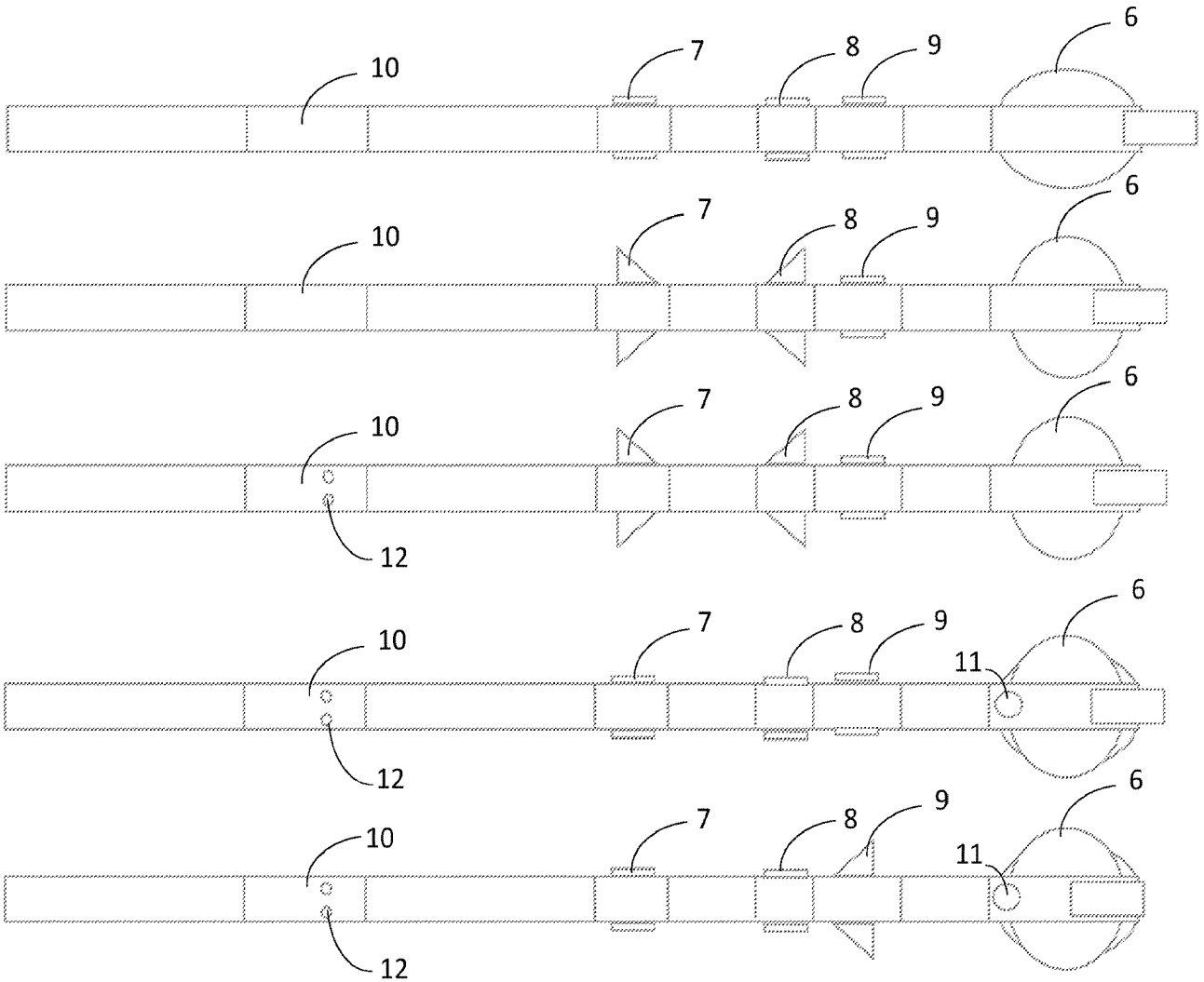
FIG. 3A-3E illustrate the BHA tool functions and elements according to the present invention.

5. A frac service string BHA tool 300 is picked up and comprises:

i. a locator device or sub 6, which in FIG. 3A is shown in its collapsed run-in position, ii. a sleeve production opening tool 9, which in FIG. 3A is shown in its collapsed run-in position, iii. a sleeve fracturing opening tool 8, which in FIG. 3A is shown in its collapsed run-in position, iv. a sleeve closing tool 7, which in FIG. 3A is shown in its collapsed run-in position, and v. a frac ported sub 10, which in FIG. 3A is shown in its closed run-in position.

6. The frac service string 120 (with the BHA tool 300 mounted at the end thereof) is run to the bottom of the well 100 passing through liner 110 top and all frac sleeve assemblies 2 and ID restrictions 3 without any interference (see FIG. 4).

Figure 5:
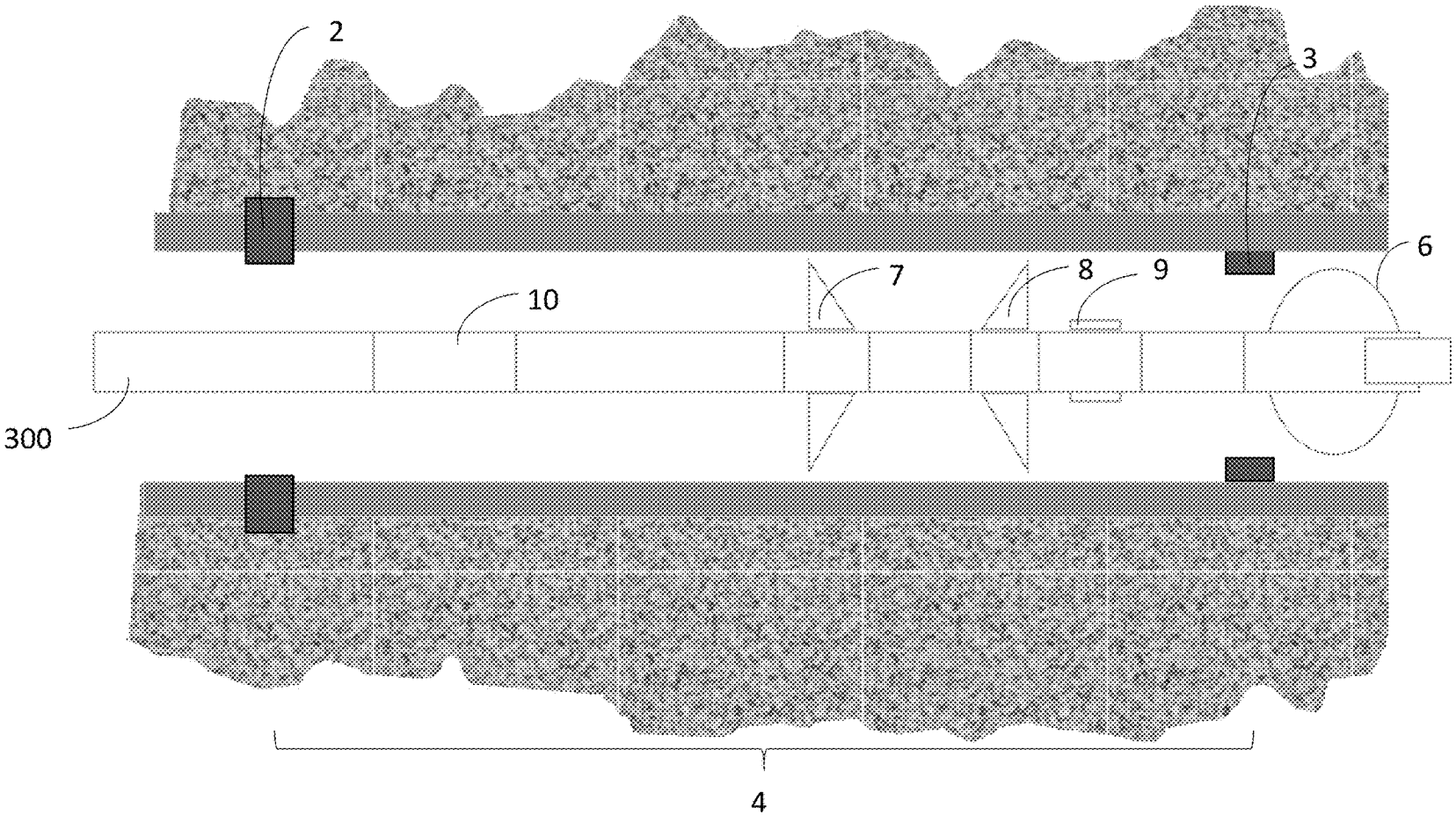
FIG. 5-15 illustrate the system and the method overview and functionality including all stages/steps in accordance with the present invention.

7. The TD (total depth), i.e. the bottom of the wellbore 100, is tagged, and locator device 6, fracturing opening tool 8 and sleeve closing tool 7 are activated by compression (see FIG. 3B). Alternatively, pressure activation of same tools can be utilized (see FIG. 5).

Figure 6:
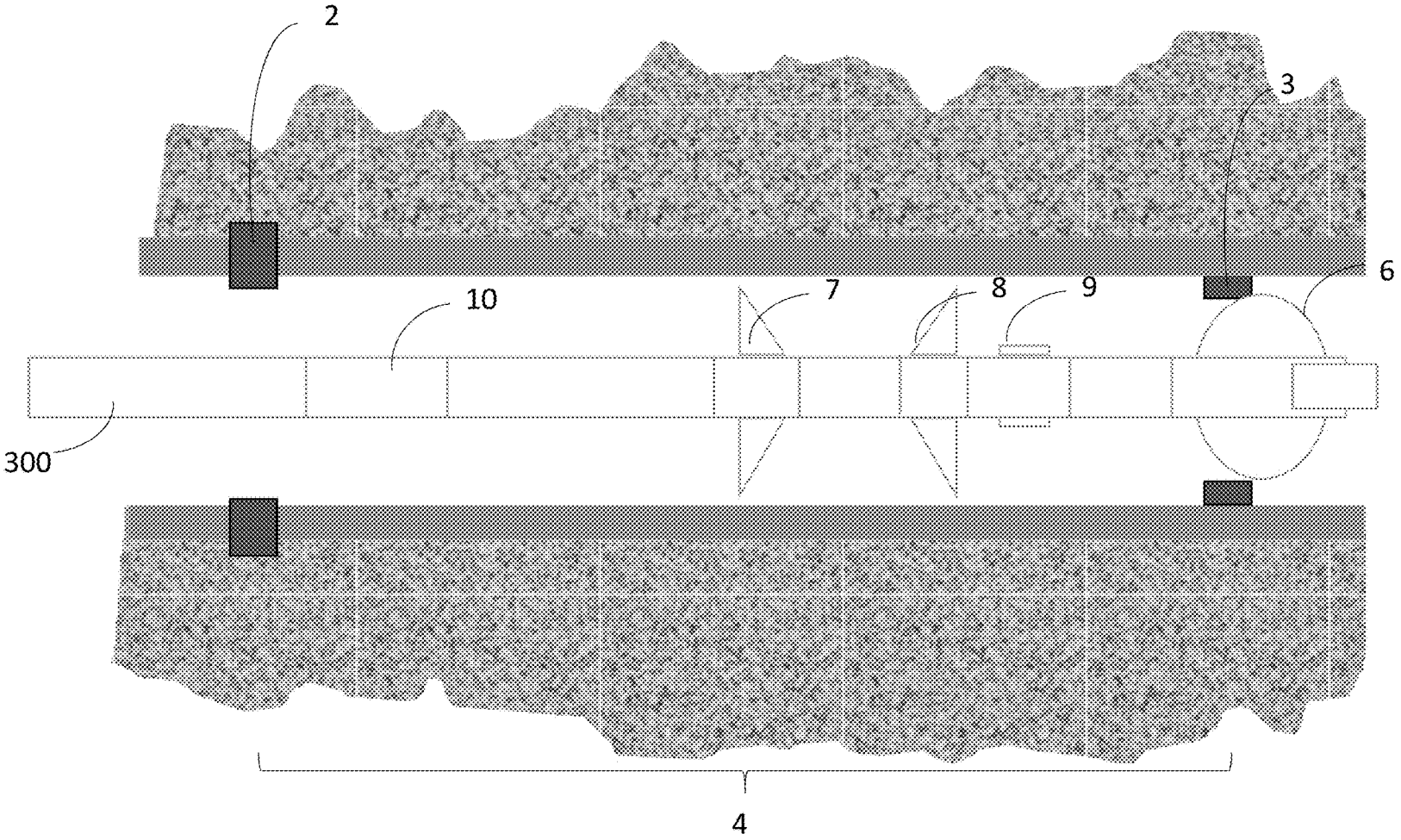

8. The BHA tool 300 is pulled up until the locator sub 6 indicates in lower most ID restriction 3. The pipe is flagged, meaning that a mark is put on the service string 120 that extends above the rig floor. When moving the service string 120 up, the position of the BHA 300 in the well 100 is known (see FIG. 6).

i. The locator device 6 will now indicate by overpull in ID restriction(s) 3 moving up. At the same time, downward movement from above will be prevented through the ID restriction 3. This means that after the locator device 6 is activated some resistance can be noticed when the string is being pulled up from below and up through the ID restriction 3, while at the same time it will not be possible for the locator device 6 to pass the ID restriction 3 from above and down (see FIG. 6).

ii. The fracturing opening tool 8 can open all sleeves 2 when going down.

iii. The sleeve closing tool 7 can close an opened sleeve 2 when moving up.

Figure 7:
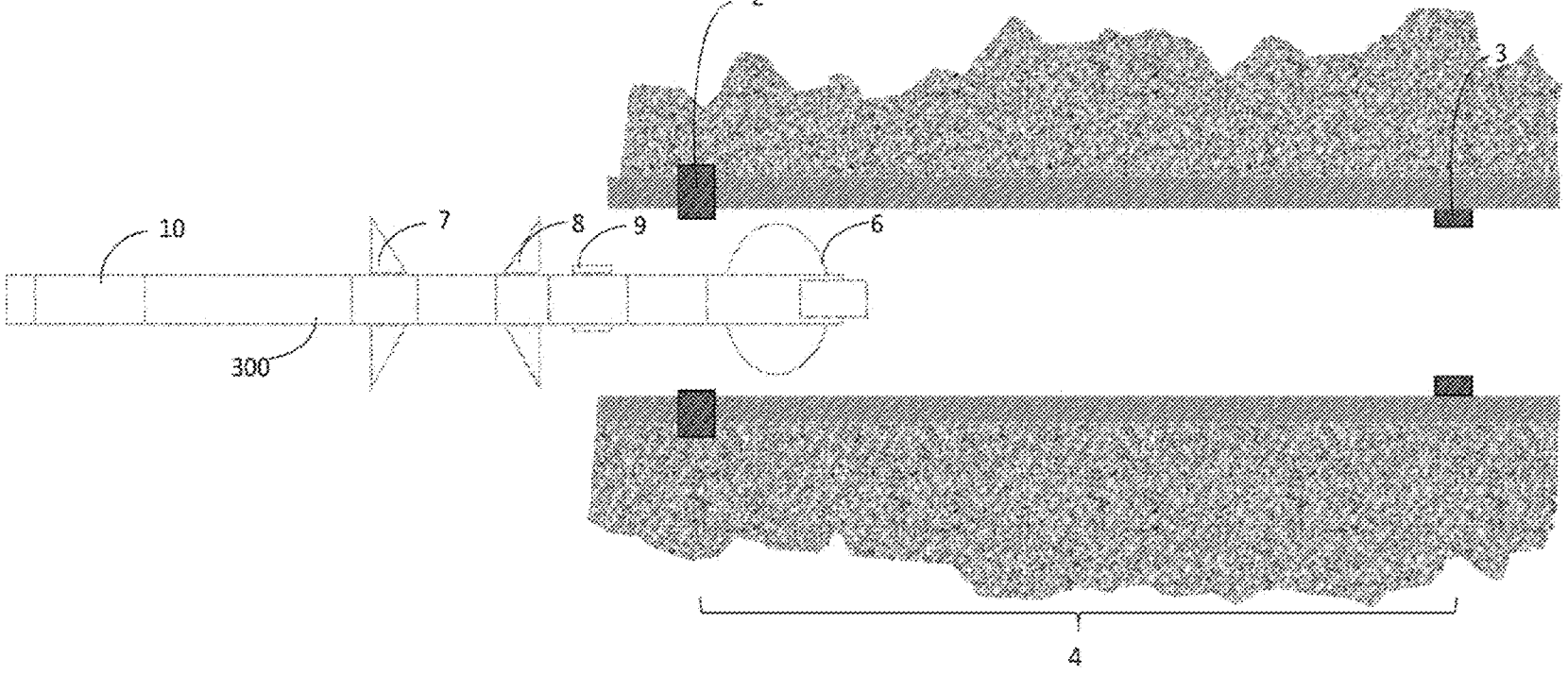

9. The frac string 120 with the BHA tool 300 is pulled such that the shifting tools 7, 8, 9 are located above the frac sleeves 2 (see FIG. 7). This means that the string 120 is moved/pulled up so that the shifting tools 7, 8, 9 are placed over the area where the sleeve 2 is positioned in the liner 110.

Figure 8:
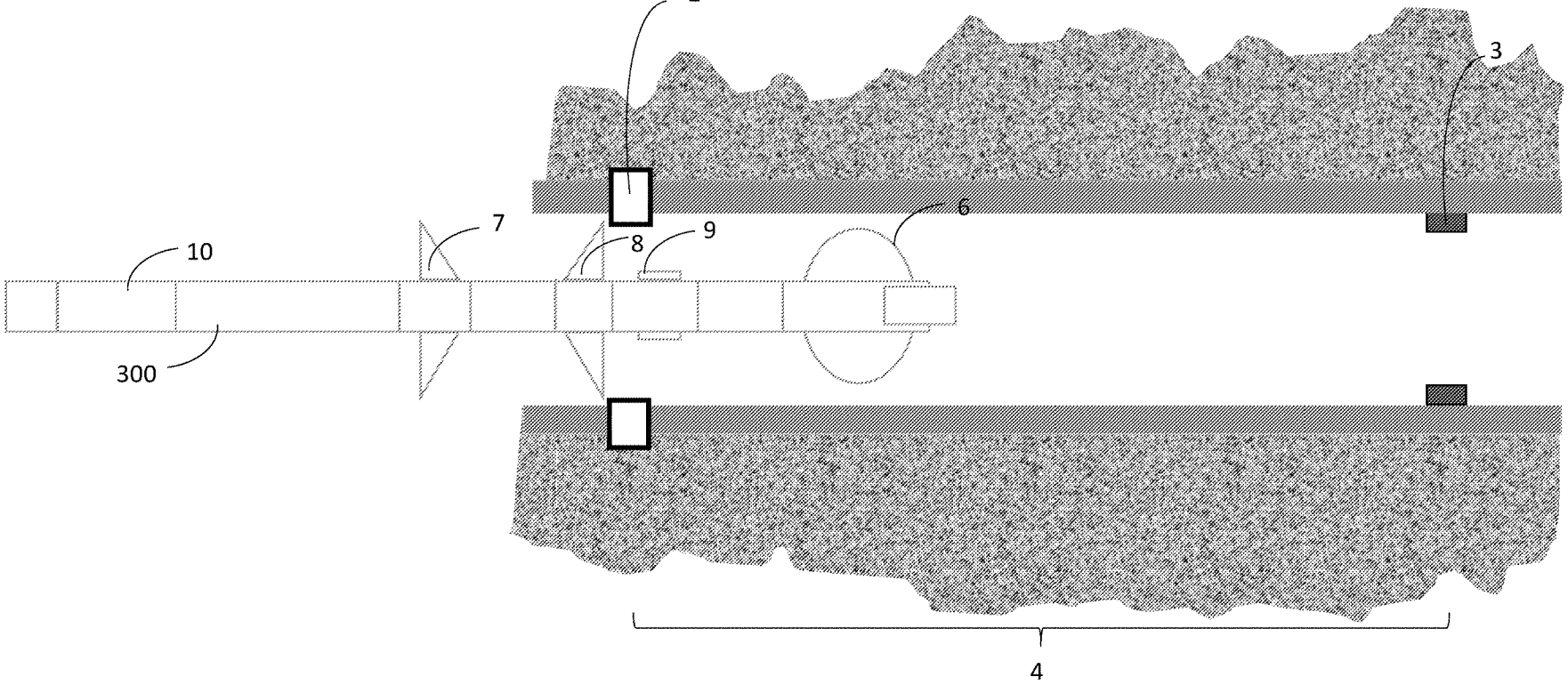
Figure 9:
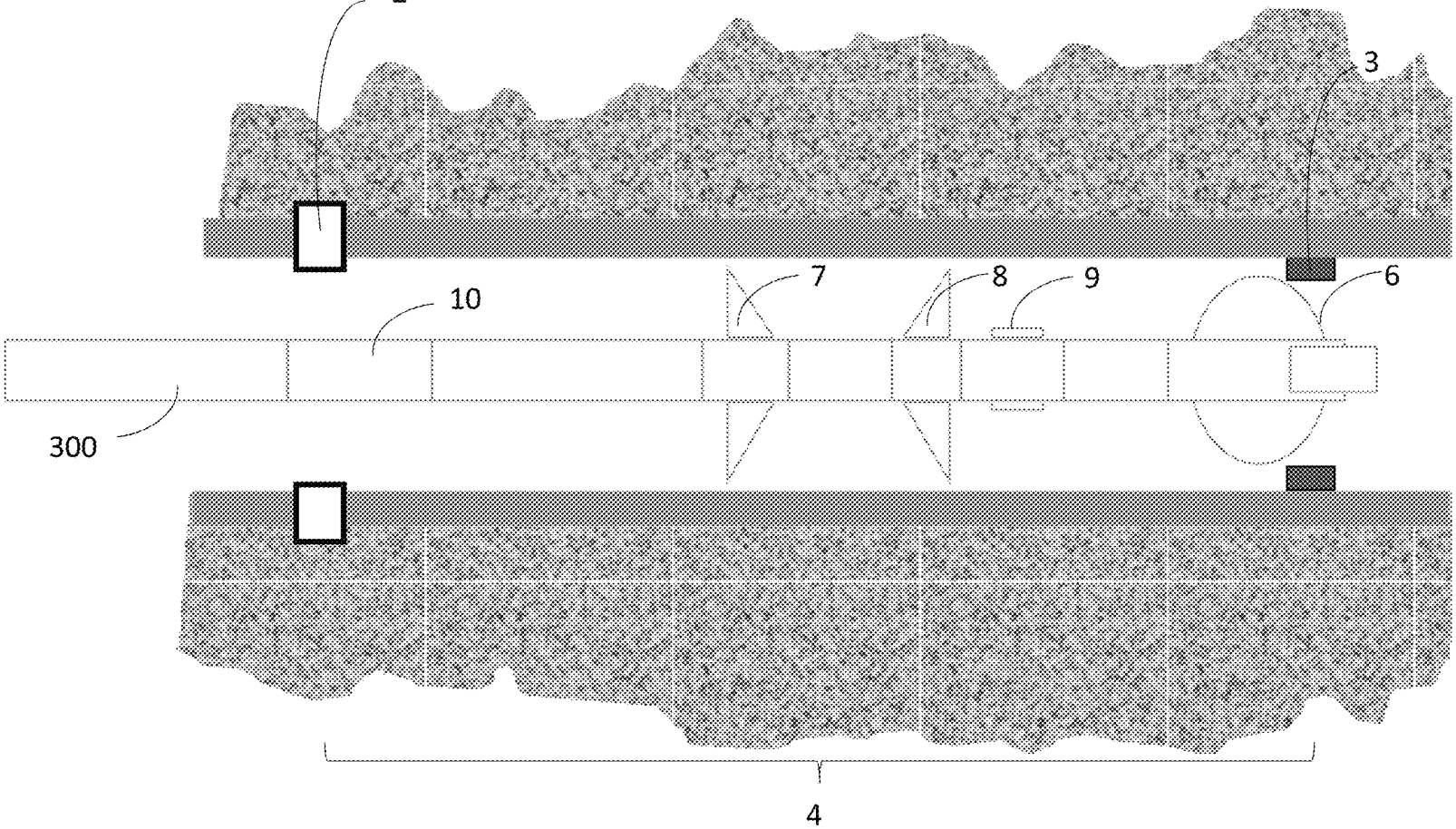
Figure 10:
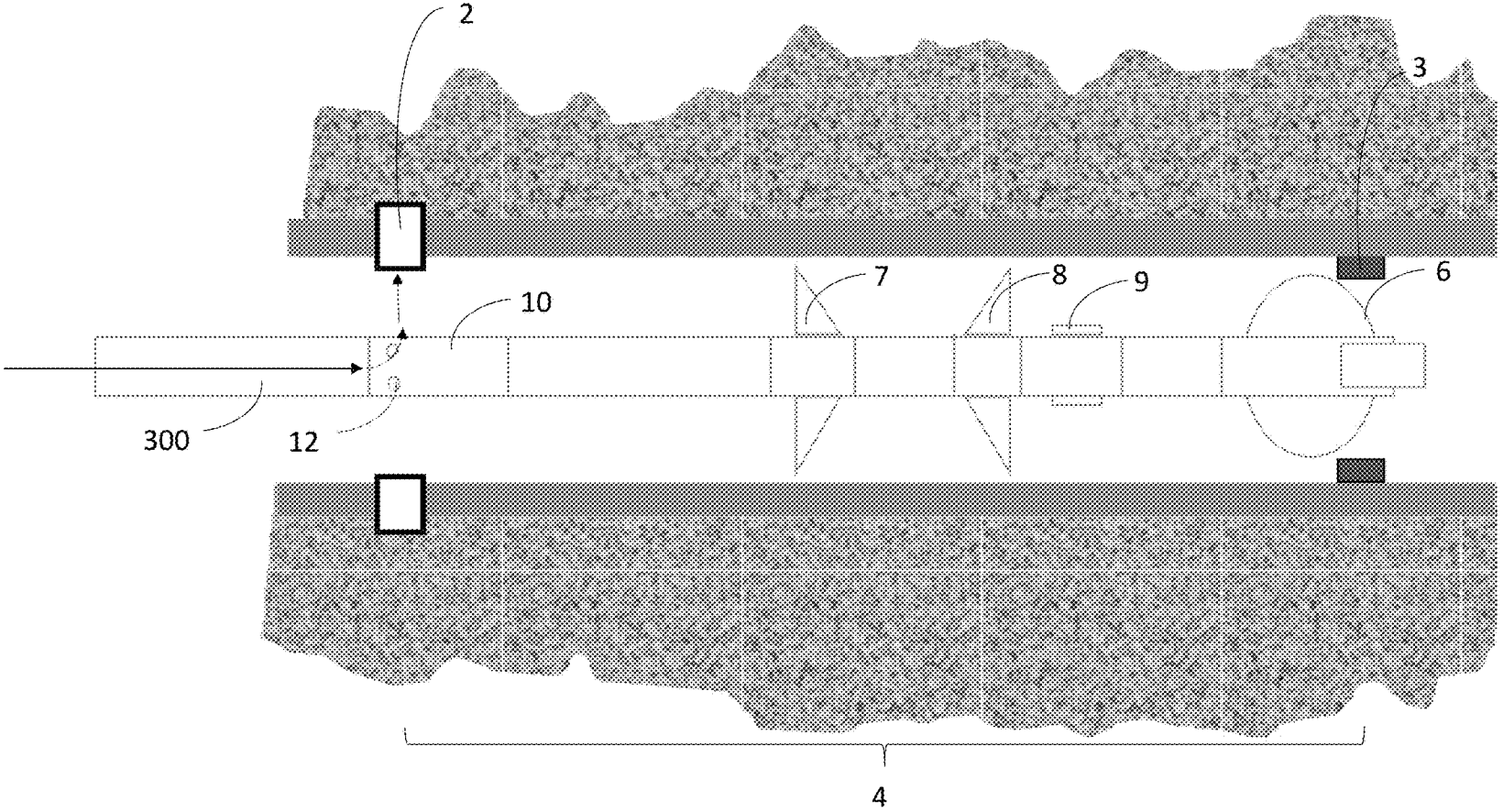

10. The string 120 with the BHA tool 300 is lowered. The frac sleeve 2 is opened by the fracturing opening tool 8 (see FIG. 8). The BHA tool 300 is run in further, and the ID restriction 3 is tagged with the help of the locator device 6 (see FIG. 9). Then we can slack off the weight of the string 120 in order to confirm the frac position. The slack off step opens the ports 12 of the frac sub 10 (see FIG. 3C), wherein the frac sub 10 is now located parallel to the opened frac sleeve 2 (see FIG. 10).

11. The annular 100 is closed, and injection is established. Frac is pumped until screen out is established (see the arrows in FIG. 10). Screen out is associated with sand (proppant) being pumped into the formation 130 in order to create fractures. When screen out is reached the formation 130 will not take in any more sand (proppant), and practically this operation is finished/completed.

Figure 11:
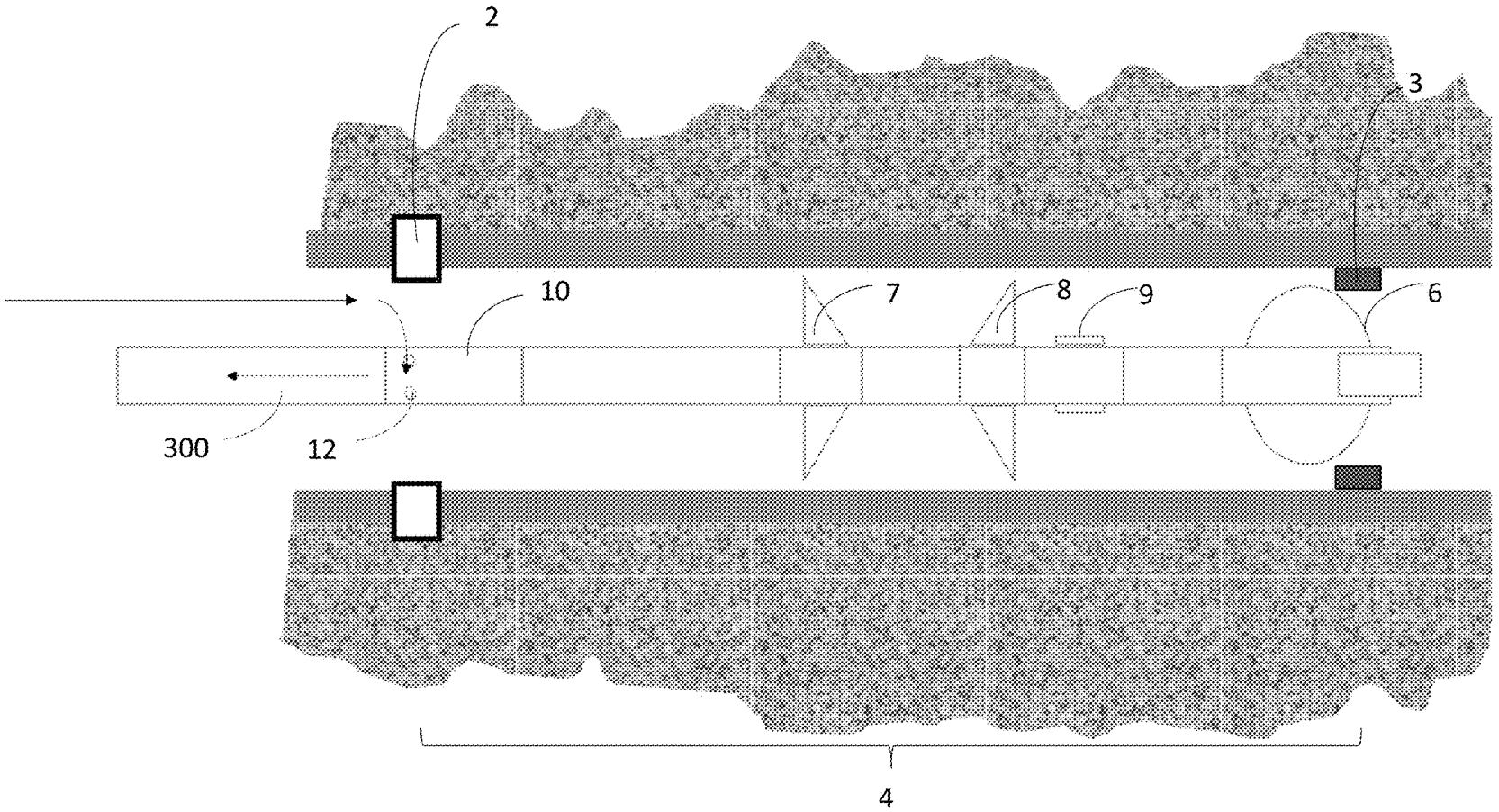

12. The annular 100 is opened, and a small volume is reverse circulated in order to clean the area outside of frac port 12 sub 10 (see the arrows in FIG. 11).

Figure 12:
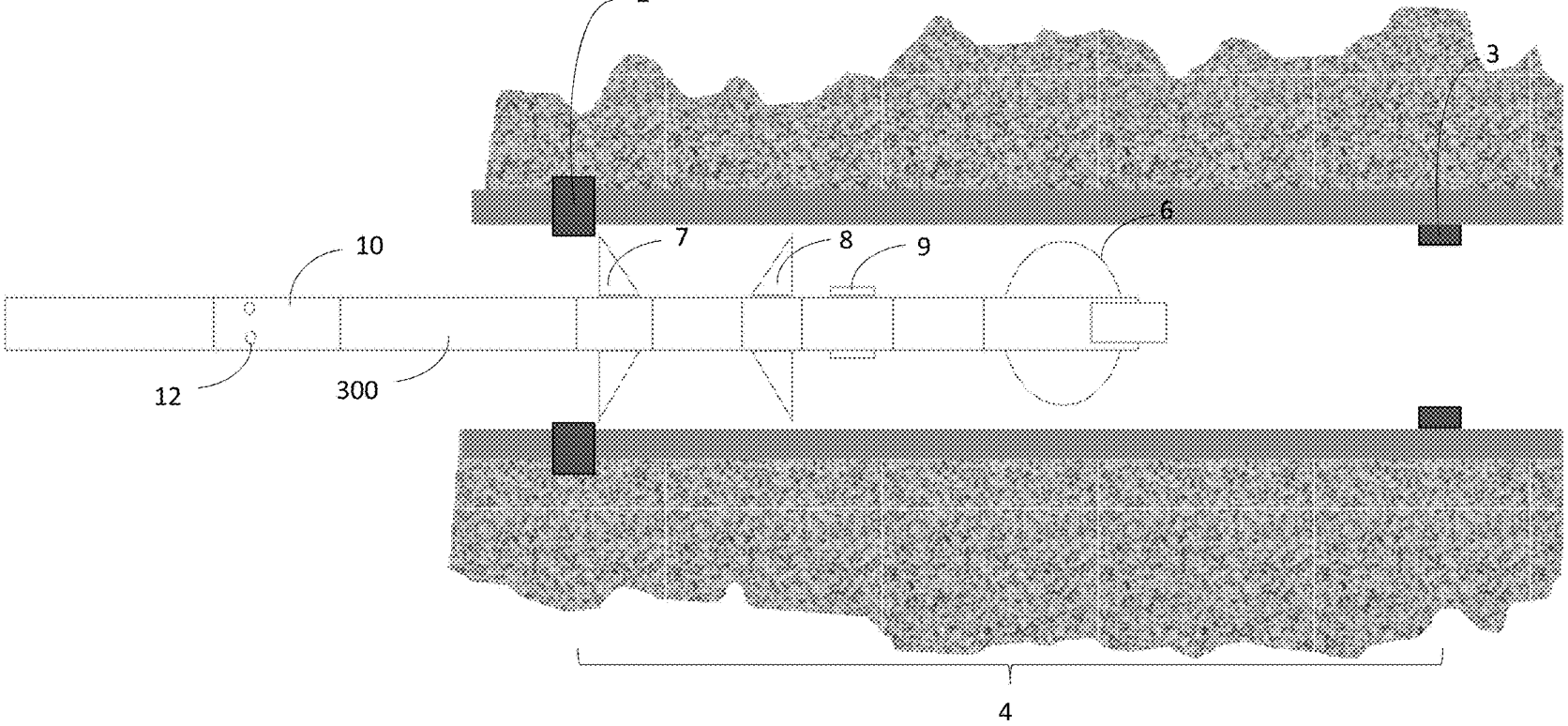

13. The BHA tool 300 is pulled up, and the sleeve 2 is closed with the help of the sleeve closing tool 7 (see FIG. 12). Then we can slack off and relocate on ID restriction 3 (see FIG. 9). This means that the string 120 is lowered towards and supported against the ID restriction 3 with the help of the locator sub 6.

14. Reverse circulate out all excess proppants from the service string 120. Circulate and reverse circulate as required (see FIG. 11).

15. The BHA tool 300 is pulled up, and the next ID restriction 3 is located. Steps 8-14 are then repeated.

Figure 13:
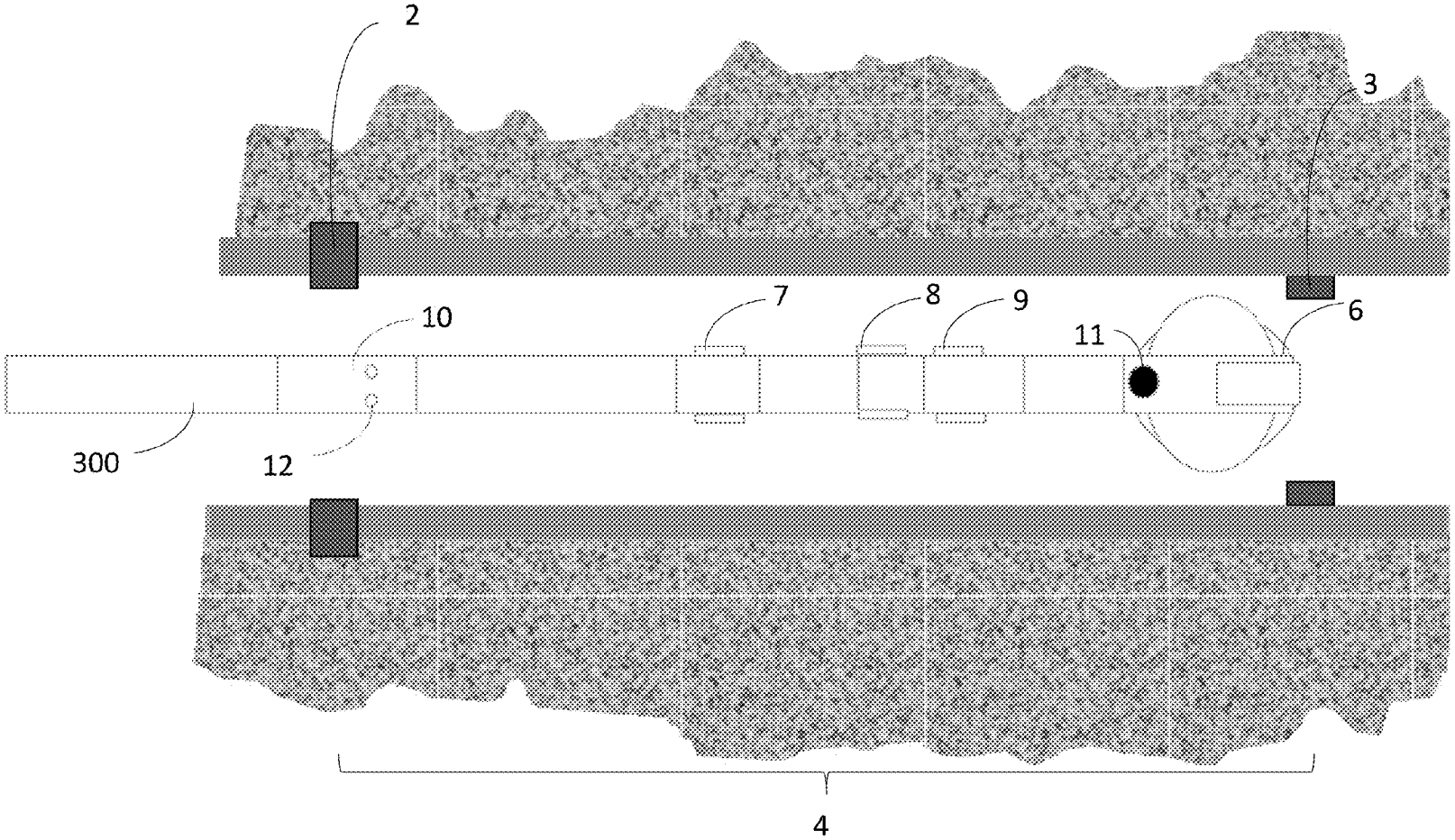

16. Once the desired number of or all stages throughout the liner 110 are fractured and all sleeves 2 are closed, a drop ball 11 (see FIGS. 13 and 3D) is used in order to deactivate the locator sub 6, the sleeve fracturing opening tool 8 and the sleeve closing tool 7. The locator sub 6 can still indicate on up/upward movement, but does not locate on down/downward movement.

Figure 14:
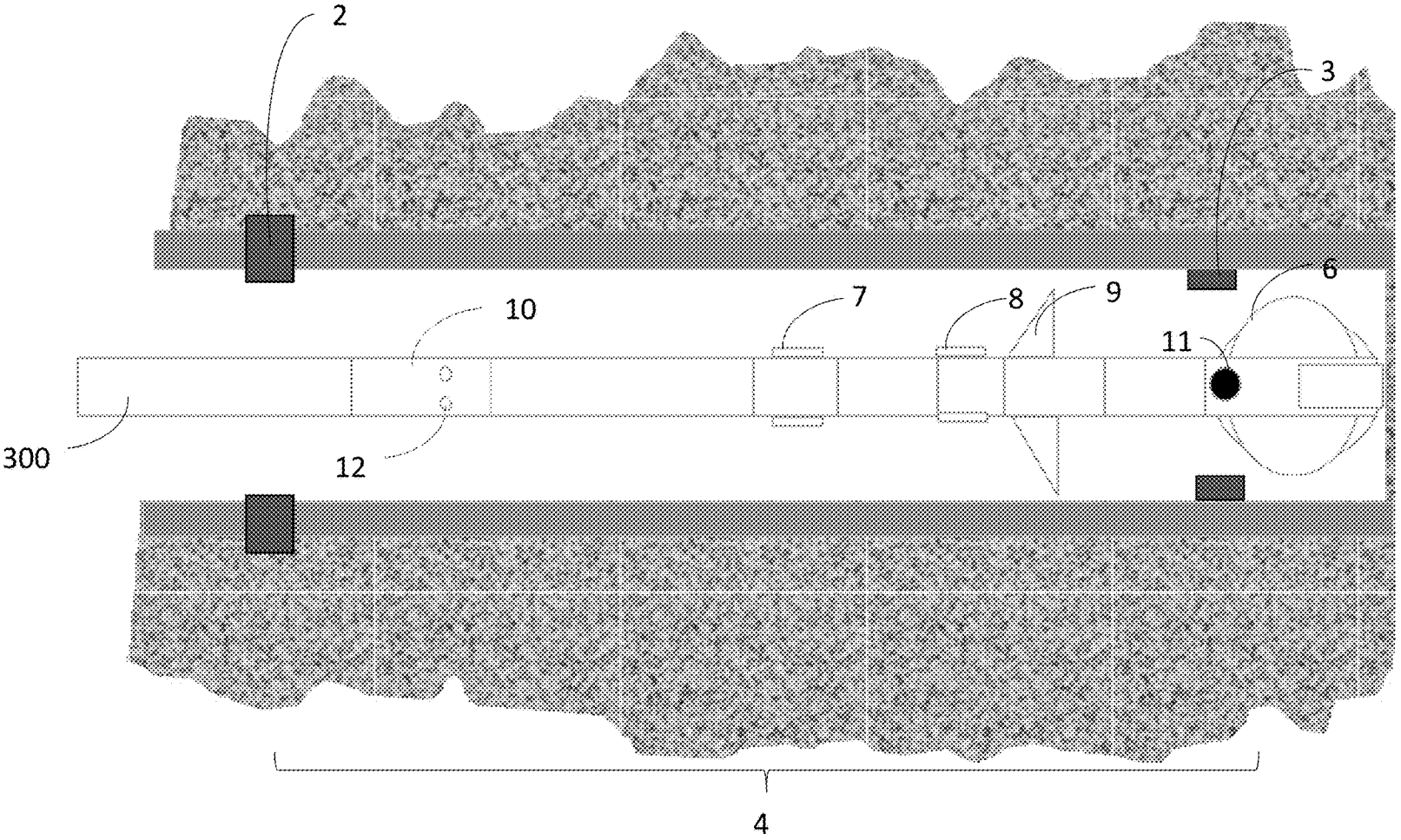

17. The BHA tool 300 is run to the TD, i.e. the bottom of the wellbore 100. The bottom is tagged in order to activate the sleeve production opening tool 9 (see FIGS. 14 and 3E) and circulate well 100 to balanced fluid.

Figure 15:
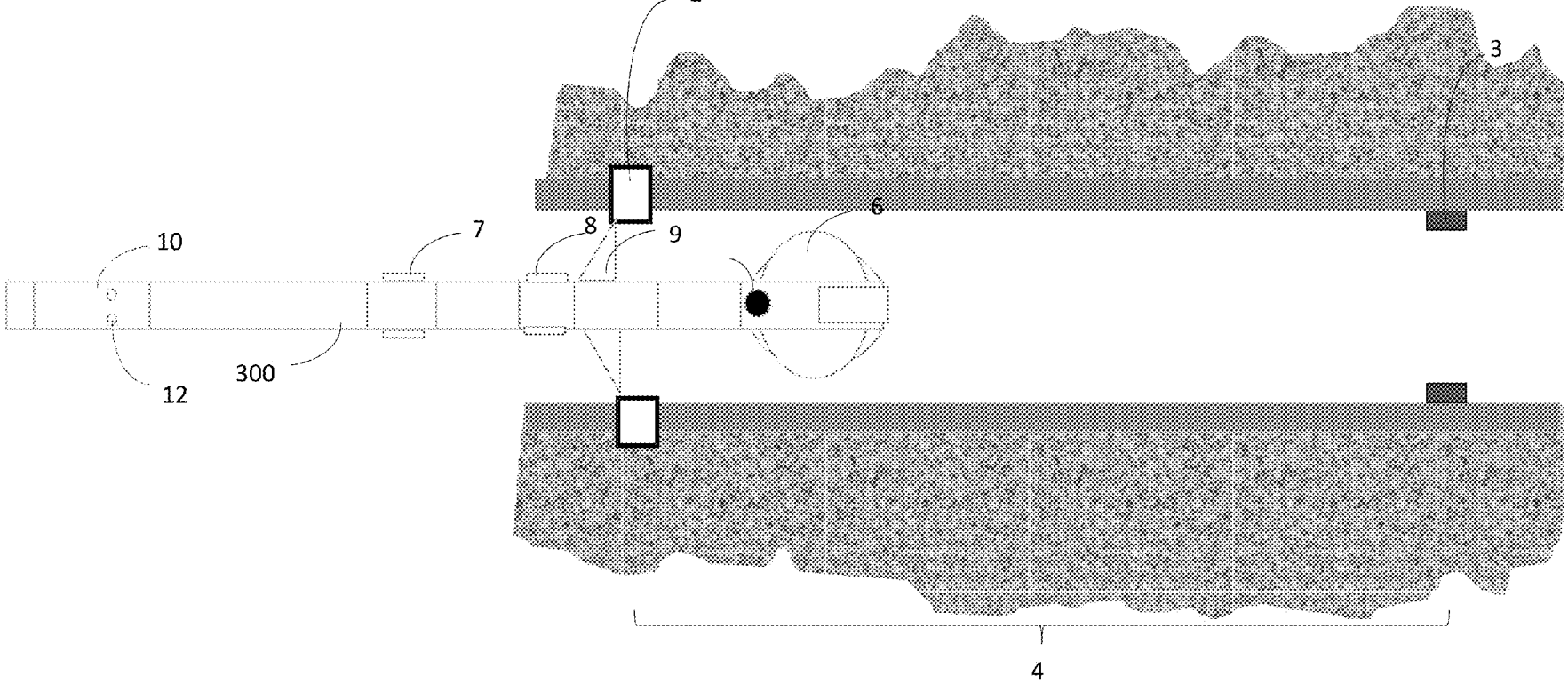

18. The BHA tool 300 is pulled up and located on lower ID restriction 3; the string 120 together with the BHA tool 300 is pulled up or moved upward in order to get sleeve production opening tool 9 above the sleeve 2; the string 120 is slacked off and sets the sleeve 2 in production mode (see FIG. 15). As said, the BHA tool 300 locates on lower ID restriction 3 when pulling up. The locator device 6 is deactivated at this stage.

19. Step 18 is repeated for a desired number of/some or all sleeves 2 in a desired number of/some or all stages. The desired or all sleeves 2 are opened and put in screened production mode.

20. Run middle completion with deep barrier plug and upper completion as well completion preference dictate. This means that when the operations, as described and claimed, are finished/completed then the entire well 100 is finalized and made ready for production, wherein middle completion, upper completion, etc. are a part of this process.

The term "slack off" relates to resting the string 120 on a solid base (such as e.g. the bottom of the well 100) or a profile (such as e.g. the indicator sub/ID restriction 3) so that the weight of the string 120 above is transferred to the BHA tool 300. When slacking off a string 120 the weight of the string 120, measured on the surface above, will be lower and can: 1) be used as an indication where the BHA 300 is located, or 2) be functioning a tool downhole.

Additional modifications, alterations and adaptations of the present invention will suggest themselves to those skilled in the art without departing from the scope of the invention as expressed and stated in the following patent claims.

The invention claimed is:

1. BHA tool for single trip through drill pipe proppant fracturing, being at one end adapted to be attached to a string and comprising:

i) a ported sub with a number of ports having opened and closed positions;

ii) sleeve shifting tools; and iii) a locator sub being arranged at the other end of the BHA tool and adapted to be activated by tagging the bottom of the wellbore;

wherein the sleeve shifting tools comprise:

i) a sleeve closing tool adapted to close a sleeve cemented in a liner when the BHA tool is moving or going up;

ii) a sleeve fracturing opening tool adapted to open the sleeve when the BHA tool is moving or going down; and iii) a sleeve production opening tool adapted to set the sleeve in a production mode.

2. BHA tool according to claim 1, wherein the ported sub with its ports, the sleeve closing tool, the sleeve fracturing opening tool, the sleeve production opening tool and the locator sub are arranged on the BHA tool in such a manner that at least one of them will be able to cooperate with at least one of: the sleeve in the liner, an ID restriction in the liner and the bottom of a wellbore.

3. System according to claim 1, wherein the ported sub with its ports, the sleeve closing tool, the sleeve fracturing opening tool, the sleeve production opening tool and the locator sub are arranged on the BHA tool in such a manner that at least one of them will be able to cooperate with at least one of: the sleeve in the liner, the ID restriction in the liner and the bottom of the wellbore.

4. BHA tool according to claim 1, wherein the sleeve fracturing opening tool and the sleeve closing tool are each adapted to be activated by tagging the bottom of the wellbore;

wherein the sleeve fracturing opening tool and the sleeve closing tool are each adapted to be deactivated by dropping a drop ball through the BHA tool.

5. BHA tool according to claim 1, wherein the locator sub, the sleeve fracturing opening tool and the sleeve closing tool are each adapted to be deactivated by a drop ball.

6. BHA tool according to claim 5, wherein the sleeve production opening tool is disposed between the locator sub and at least one of the sleeve fracturing opening tool and the sleeve closing tool.

7. BHA tool according to claim 5, wherein the sleeve fracturing opening tool and the sleeve closing tool are each adapted to be activated by tagging the bottom of the wellbore.

8. BHA tool according to claim 1, wherein the locator sub is adapted to be alternatively activated and deactivated;

wherein the locator sub, when activated, is adapted to provide indication during both upward and downward movement of the BHA tool in a the liner; and wherein the locator sub, when deactivated, is adapted to provide indication during upward movement but not during downward movement of the BHA tool in the liner.

9. BHA tool according to claim 1, wherein the locator sub is inflatable.

10. System for single trip through drill pipe proppant fracturing, comprising:

a predetermined number of sleeves cemented in a liner in a wellbore in a subterranean formation and a predetermined number of ID restrictions;

wherein, in each stage throughout a certain or the entire length of the liner, there is a predetermined spacing or distance between one of the ID restrictions and an adjacent one of the predetermined number of sleeves;

wherein the system further comprises a BHA tool being at one end adapted to be attached to a string and comprising:

i) a ported sub with a number of ports having opened and closed positions;

ii) sleeve shifting tools; and iii) a locator sub being arranged at the other end of the BHA tool;

wherein the sleeve shifting tools comprise:

i) a sleeve closing tool adapted to close the sleeve when the BHA tool is moving or going up;

ii) a sleeve fracturing opening tool adapted to open the sleeve when the BHA tool is moving or going down; and iii) a sleeve production opening tool adapted to set the sleeve in a production mode and adapted to be activated by tagging the bottom of the wellbore.

11. System according to claim 10, wherein the locator sub is adapted to be alternatively activated and deactivated;

wherein the locator sub, when activated, is adapted to provide indication during both upward and downward movement of the BHA tool in the liner.

12. System according to claim 11 wherein the locator sub, when deactivated, is adapted to provide indication during upward movement but not during downward movement of the BHA tool in the liner.

13. Method for single trip through drill pipe proppant fracturing, comprising the following steps:

a) arranging a liner with a predetermined number of sleeves and ID restrictions in a wellbore in a subterranean formation, wherein the sleeves and the ID restrictions are being cemented in the liner, and wherein, in each stage (1, 2, 3, 4 . . . n, n+1, n+2, n+3, n+4) throughout a certain or the entire length of the liner, the ID restriction and the sleeve are arranged with a predetermined spacing or distance between them;

b) clean out run is performed by means of a string having a clean out run string end, wherein the inside of the liner is thus being flushed and cleaned;

c) lowering a BHA tool being at one end adapted to be attached to the string and comprising: i) a ported sub with a number of ports having opened and closed positions, ii) sleeve shifting tools, and iii) a locator sub being arranged at the other end of the BHA tool, wherein the sleeve shifting tools comprise: i) a sleeve closing tool adapted to close the sleeve when the BHA tool is moving or going up; ii) a sleeve fracturing opening tool adapted to open the sleeve when the BHA tool is moving or going down; and iii) a sleeve production opening tool adapted to set the sleeve in a production mode;

d) the string with the BHA tool is run to the bottom of the wellbore passing through the top end of the liner and all sleeve assemblies and ID restrictions without any interference;

e) the bottom of the wellbore is tagged, and the locator sub, the sleeve fracturing opening tool and the sleeve closing tool are activated;

f) the BHA tool is pulled up until the locator sub indicates in lower most ID restriction;

g) the string with the BHA tool is pulled such that the sleeve shifting tools are located above the sleeve in the liner;

h) the string with the BHA tool is lowered, and the sleeve is opened by the sleeve fracturing opening tool;

i) the BHA tool is run in further, and the ID restriction is tagged with the help of the locator sub;

j) the weight of the string is slacked off the in order to confirm the frac position, wherein the slack off step opens the ports of the ported sub and the ported sub is located parallel to the opened sleeve;

k) an annular space between the liner and the string is closed, and injection is established, and then frac is pumped until screen out is established;

l) the annular space is opened, and a predetermined volume is reverse circulated in order to clean the area outside of the ported sub;

m) the BHA tool is pulled up, and the sleeve is closed with the help of the sleeve closing tool;

n) the weight of the string is slacked off, and the BHA tool is relocated on the ID restriction with the help of the locator sub;

o) all excess proppants from the string are reverse circulated out;

p) the BHA tool is pulled up, and the next ID restriction is located;

q) then steps f)-p) are repeated for some or all stages (1, 2, 3, 4 . . . n, n+1, n+2, n+3, n+4) throughout the liner.

14. Method according to claim 13, wherein, when some or all stages (1, 2, 3, 4 . . . n, n+1, n+2, n+3, n+4) throughout the liner are fractured and all sleeves are closed, a drop ball is used in order to deactivate the locator sub, the sleeve fracturing opening tool and the sleeve closing tool.

15. Method according to claim 14, wherein the BHA tool is run to the bottom of the wellbore, then the bottom is tagged in order to activate the sleeve production opening tool and a fluid is circulated in the wellbore.

16. Method according to claim 15, wherein the BHA tool is pulled up and located on lower ID restriction, then the string with the BHA tool is pulled up to get the sleeve production opening tool above the sleeve, then the string is being slacked off to set the sleeve in production mode, wherein the above steps are repeated for some or all sleeves in order to open some or all sleeves in some or all stages and put them in screened production mode.

17. Method according to claim 13, wherein the activated sleeve fracturing opening tool is adapted to be able to open all sleeves when going down.

18. Method according to claim 13, wherein the activated sleeve closing tool is adapted to be able to close any opened sleeve when moving up.

* * * * *